United States Patent [19]

Chenoweth et al.

[11] Patent Number: 4,509,599

[45] Date of Patent: Apr. 9, 1985

[54] GAS WELL LIQUID REMOVAL SYSTEM AND PROCESS

[75] Inventors: David V. Chenoweth, Lahaina, Hi.; David M. McStravick, Houston, Tex.

[73] Assignee: Baker Oil Tools, Inc., Orange, Calif.

[21] Appl. No.: 432,166

[22] Filed: Oct. 1, 1982

[51] Int. Cl.[3] ..... E21B 36/00; E21B 43/25; E21B 43/34

[52] U.S. Cl. ..... 166/370; 166/60; 166/61; 166/68.5; 166/267; 166/302; 166/372

[58] Field of Search ..... 166/53, 60, 61, 67, 166/68.5, 105.5, 267, 302, 369, 370, 372

[56] References Cited

U.S. PATENT DOCUMENTS

| | | | |
|---|---|---|---|
| 1,017,722 | 2/1912 | Wintz | 166/68.5 |
| 1,723,682 | 8/1929 | Deming | 166/369 X |
| 1,758,376 | 5/1930 | Sawyer | 166/267 X |
| 1,798,774 | 3/1931 | Yates | 166/267 |
| 1,970,295 | 8/1934 | Fitzpatrick | 166/60 |
| 2,061,865 | 11/1936 | Wells | 166/372 X |
| 2,942,663 | 6/1960 | Haggard | 166/67 X |
| 3,363,692 | 1/1968 | Bishop | 166/67 X |
| 4,226,284 | 10/1980 | Evans | 166/372 X |
| 4,275,790 | 6/1981 | Abercrombie | 166/372 |
| 4,345,647 | 8/1982 | Carmichael | 166/370 X |
| 4,437,514 | 3/1984 | Canalizo | 166/372 X |

FOREIGN PATENT DOCUMENTS

| | | | |
|---|---|---|---|
| 345266 | 8/1972 | U.S.S.R. | 166/53 |

*Primary Examiner*—George A. Suchfield
*Attorney, Agent, or Firm*—Norvell & Associates

[57] ABSTRACT

A split-stream method and apparatus for preventing the accumulation of liquids, such as water or oil, in subterranean gas wells having low shut-in bottom hole pressures is provided. A compressor whose capacity can be less than the theoretical adiabatic horsepower for full wellhead depletion, is used to remove a two-phase liquid-gas mixture through a secondary fluid transmission conduit. Production of dry gas in larger quantities through a primary production conduit is then possible since liquids cannot accumulate to kill the well. An optional mechanism for initiating production in very low pressure wells and a means of preventing the buildup of paraffin is also described.

18 Claims, 4 Drawing Figures

GAS WELL LIQUID REMOVAL SYSTEM AND PROCESS

BACKGROUND OF THE INVENTION

1. Field of the Invention

The invention relates to a method and apparatus for the prevention of accumulation of water in comparatively low flow, low pressure wells.

2. Description of the Prior Art

The accumulation of liquids such as water in a natural gas well tends to reduce the quantity of natural gas which can be produced from a given well. As stated in paper SPE 2198 of the Society of Petroleum Engineers of AIME, authored by R. G. Turner, A. E. Dukler and M. G. Hubbard:

> "In many instances, gas phase hydrocarbons produced from underground reservoirs will have liquid-phase material associated with them, the presence of which can effect the flowing characteristics of the well. Liquids can come from condensation of hydrocarbon gas (condensate) or from interstitial water in the reservoir matrix. In either case, the higher density liquid-phase, being essentially discontinuous, must be transported to the surface by the gas. In the event the gas phase does not provide sufficient transport energy to lift the liquids out of the well, the liquid will accumulate in the well bore. The accumulation of the liquid will impose an additional back-pressure on the formation and can significantly affect the production capacity of the well. In low-pressure wells the liquid may completely kill the well, . . . . "

There are many methods for the removal of liquids from a gas well. The simplest method of removing liquid from a gas well is to periodically blow the well down to a lower surface pressure, such as atmospheric pressure or the pressure in a storage tank. Perhaps the most common method of unloading a well with insufficient bottom hole pressure to allow production, is to run a small siphon string into the well and from time to time open the siphon string to atmospheric pressure. The small siphon strings might typically have a diameter of perhaps 1 or $1\frac{1}{4}$ inch. It also has been common practice to drill small "weep holes" siphon strings to enable gas to enter and prevent U-tube stallout during loading. The object behind the installation of this small tubing string and closing in the annulus is to reduce the production flow area and therefore increase the gas velocity in the smaller production string. The method can be used on low volume gas wells where a reduced production rate due to increased flowing friction is not a significant problem. Flow rates between 200 and 300 Mcf/d are required to lift liquid through a one inch tubing string at a surface flowing pressure of 600 psi and a surface flowing temperature of 540° Rankine. This relatively simple solution results in the continuous production of both gas and liquid through the same producing string.

An alternative method employing small diameter siphon tubing strings is to produce gas up the tubing casing annulus and to periodically unload accumulated liquids by exposing the siphon tubing to low surface pressures. Accumulated liquids may also be removed through a siphon tubing by forcing liquids and gas up the siphon tubing through surface production equipment by periodically subjecting the casing tubing annulus to a high pressure.

These and other means of producing gas, despite the accumulation of liquids such as water in the formation, are described in a paper entitled "A Practical Approach to Removing Gas Well Liquids" by Hutless and Brandberry originally presented in 1971.

Differential pressure intermitters have also been used to unload gas wells. These devices measure the difference between siphon string pressure and casing pressure, determine the amount of water in the siphon tubing and blow the well when adequate load of water is detected. Gas is produced through the tubing casing annulus, and is slowly bled from the siphon string to cause water in the well bore to move into the siphon string. The pressure difference between the siphon string and the casing determines the amount of water in the siphon string. However, the efficiency of the differential pressure intermitter is dependent upon the bleed rate. If the bleed rate is too slow, liquids will build up in the casing. If the bleed rate is too fast, unnecessary amounts of gas are bled from the tubing and wasted to the atmosphere.

Downhole pumps can also be employed. In these installations liquid is pumped up the tubing and gas is produced up the tubing casing annulus. Downhole pumps caan be used to continue production in wells where the abandonment pressure is considered to be between 30 and 50 psi at the surface. Downhole pumping means are conventionally employed with wells which have been logged off and which can no longer be unloaded with siphon strings or intermitters. A typical downhole pumping unit comprises an electric motor, a pump, rods and other ancillary equipment.

Another means of unloading accumulated liquids is to employ a combination of a liquid diverter used with a gas lift valve. This system also produces gas through the tubing-casing annulus and lifts the liquid out through the tubing. The liquid diverter is employed to allow liquid to enter the tubing string which is open to atmospheric or separator pressure. After a sufficient quantity of liquid has entered the tubing string, the gas lift valve is actuated to lift this liquid to the surface, thus periodically unloading the well.

Finally, U.S. patent application Ser. No. 75,627 filed Sept. 14, 1979, now abandoned, discloses the use of a valve interspersed between the well output line and the production tubing to permit liquid and gas to be continuously transported through a secondary production conduit with only dry gas being produced through the primary production conduit. The formation pressure supplies adequate energy for this system.

SUMMARY OF THE INVENTION

A split-stream apparatus and method is used for transporting gas through a primary production conduit, such as the tubing-casing annulus. A smaller volume two-phase liquid-gas mixture is transported from the producing formation to the surface through a secondary fluid transmission conduit, such as a small tubing string. The gas delivered through both conduits is delivered to a gathering line at a prescribed gathering line pressure. A compressor having an output pressure equal to the gathering line pressure is positioned between the secondary conduit and the gathering line system. The input pressure to the compressor in the secondary tubing string is reduced to a value less than the gathering line pressure. The velocity of the two-phase mixture in the small tubing string can therefore be raised to a value greater than the minimum liquid transport velocity thus permitting liquid removal through the secondary string and preventing the accumulation of liquids in the well which could shut in the well. Dry gas will be produced through the primary fluid transmission conduit directly to the gathering line, resulting in much greater total production than through the secondary conduit alone. The theoretical adiabatic horsepower of a compressor used in this manner can be significantly less than the theoretical adiabatic horsepower required to produce the same quantity of fluids by using a full stream compressor placed between the wellhead and the gathering system (full wellhead depletion).

DESCRIPTION OF THE PREFERRED EMBODIMENTS

Each of the preferred embodiments of this invention comprises a split-stream system for removing gases and liquids from a subterranean oil or gas well. Each of these embodiments uses a compressor to remove a two-phase liquid-gas mixture through one fluid transmission conduit and provides for direct communication between a second fluid transmission conduit and the gathering system for collecting produced gas. The embodiments differ in that the embodiments of FIGS. 2 through 4 incorporate additional elements into this well completion permitting use of the minicompressor split-stream assembly in the presence of well conditions which could otherwise prevent the production of gas in this split-stream system.

The embodiments of FIGS. 1 through 4 are each adapted for use with a given set of well conditions. Well inflow conditions are characterized by three factors: shut-in bottom hole pressure, the liquid-gas ratio and a productivity index. The shut-in bottom hole pressure (S.I.B.H.P.) is the pressure in the well at the formation which would prevent flow from the formation into the well. The liquid-gas ratio (L.G.R.) is of course the ratio of the produced liquid to the produced gas at the formation. The inflow performance relationship characterized by index J is a measure of the producing rate of the well to its draw-down at that particular rate. This index is a measure of the well potential or ability to produce and is a commonly measured well property.

Figure 1:
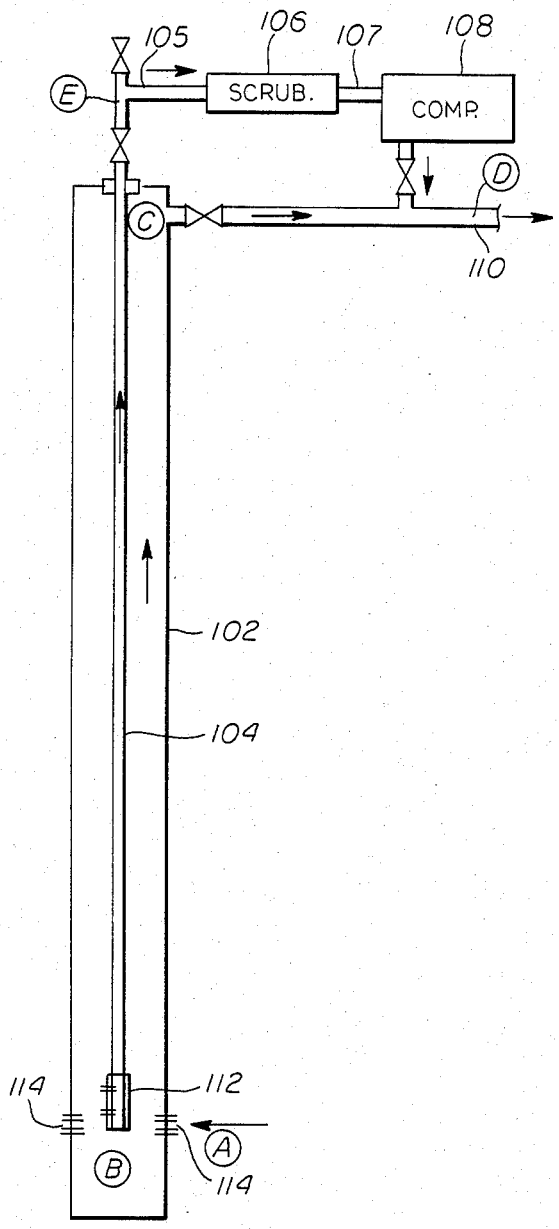
FIG. 1 is a schematic illustration of a well completion employing a compressor to prevent liquid accumulation in a well producing natural gas.

The simplest configuration employing this invention is shown in FIG. 1. This configuration can be used in a well in which gas cannot be produced without the use of an enhanced recovery mechanism such as the split-stream concept comprising this invention. In this configuration the well conditions are sufficient to sustain production of gas and to begin production at least after initial blowdown to the atmosphere upon the initiation of compression at the surface of the well in the manner depicted. FIG. 1 depicts a well having a conventional casing 102 with perforations 114 being provided in the casing 102 at a location to provide communication with the producing formation A. Communication is provided at the surface of the well between the well conduit defined by the casing and the gathering line 110 which communicates with the gathering system of a field comprising a number of wells such as that depicted herein. An interior fluid transmission conduit 104 extends from the surface of the well to the vicinity of the perforations 114. This inner fluid transmission conduit will in general have a cross-sectional area substantially less than the cross-sectional area of the annular fluid transmission conduit defined between inner transmission conduit 104 and the casing 102. Conventional screening means 112 to prevent clogging of conduit 104 is provided at the lower end thereof. For example a one inch diameter inner tubing could be used with a $4\frac{1}{2}$ to $5\frac{1}{2}$ inch casing. At the surface of the well the inner fluid transmission conduit 104 communicates with a conventional liquid-gas separator (scrubber). One form of separator which could be employed would comprise a plenum chamber in which the velocity of the two-phase liquid-gas mixture entering the chamber would be significantly reduced. As the velocity decreases in the plenum, the liquid phase of the mixture will collect on the bottom of the separator 106. A connection 107 could then be established between the upper portion of separator 106 and a compressor unit located downstream of the liquid-gas separator. The liquid-gas separator would be employed upstream of the compressor in those situations in which the two-phase liquid-gas mixture produced through inner fluid transmission conduit 104 could not be transmitted through a conventional compressor. Compressor 108 can comprise any conventional compression means. In this embodiment, the output of compressor 108 communicates with gathering line 110 at a point downstream of the point at which communication is established between the gathering line 110 and the annular area defined between casing 102 and inner fluid transmission conduit 104. Compressor-gathering line communication can, however, be established upstream of the annulus-gathering line interconnection.

The operation of this well completion for sustained production of gas from the formation to the gathering line can be understood by first considering the relative pressures existing at five different points in the producing well completion. For any well to produce, the pressure in the formation, A, must be greater than the bottomhole pressure within the well in the vicinity of the perforations 114, here identified as B. The pressure at the bottom of the well will in turn be greater than the pressure at the top of the well, C, the difference being the pressure needed to sustain the column of fluid within the well. In the configuration shown in FIG. 1, the gathering line 110 communicates directly with the annulus of the producing well, C, without any restriction. Therefore the pressure in the gathering line, that is at D, will be equal to the pressure at the surface of the well, C. If these conditions are not met the well cannot freely produce through the fluid transmission conduit defined between casing 102 and tubing 104. However if the bottomhole pressure, at B is insufficient to support the column of fluid in this fluid transmission conduit there can be no continuous production. If the well is producing both liquids and gases, the greater weight of the liquids produced would cause the well to be shut in if this pressure were insufficient to support the two-phase liquid-gas column existing between the producing formation and the surface of the well. For example under the following conditions the well alone would not sustain production.

S.I.B.H.P. $= P_A = 275$ psia
L.G.R. $= 20$ bbls/mm
$J = 5.5 \times 10^{-3}$ mcfpd/(psia)$^2$ Pressures $P_B$@4000 feet $= 110$ psia.
$P_B = 100$ psia
$P_D = 100$ psia A well having these characteristics could produce dry gas at the surface, but the presence of liquids in the form of water, oil, or other liquids would effectively kill the well. A means must therefore be provided for transporting both liquids and gases to the surface of the well if this well is to produce.

In the configuration of FIG. 1 a split-stream completion in which a combination of liquids and gases are transported through one fluid transmission conduit, here the tubing 104, and dry gas alone can be transported to the surface of the well through the second fluid transmission conduit. By incorporating a small compressor in the surface conduit communicating with the small or inner fluid transmission conduit 104 the pressure, $P_E$ at the well surface in fluid transmission conduit 104 can be reduced to a value significantly less than the pressure in the outer fluid transmission conduit, $P_C$. For example a pressure of $P_E$ equal to 70 psia would provide a sufficient pressure differential to permit the flow of a two-phase liquid-gas mixture in the smaller conduit. The pressure differential existing in tubing 104 permits the two-phase liquid-gas mixture to flow in tubing 104 at a velocity sufficient to impart an adequate amount of kinetic energy to the liquid so that the wet gas mixture is transported to the surface of the well. The compressor can then be used to raise the pressure in the conduit 107 communicating with tubing 104 to a value equal to the gathering line pressure $P_D$.

$$P_E + \text{Compressor Pressure Change} = P_D$$

It should be understood however that the flow of the two-phase liquid-gas mixture through the smaller conduit 104 is of secondary importance. The far more significant amount of fluid can be produced through the fluid transmission conduit defined between casing 102 and casing 104. For example the dry gas produced in this annular area could be on the order of ten times the amount of fluids produced through the smaller wet gas tubing string 104. By positioning the compressor in communication with the smaller secondary tubing string 104 a compressor having a theoretical adiabatic horsepower significantly less than that required by a compressor attached at the wellhead to produce both the secondary and primary quantity of fluids could be achieved. For example a compressor having a theoretical adiabatic horsepower of 1.95 could be employed to produce 350 million cubic feet per day of dry gas from a well having the characteristics previously identified. This theoretical adiabatic horsepower would be significantly less than that required for a compressor attached to the gathering line to provide full wellhead depletion and production only through a single conduit extending between the surface of the well and the producing formation 4000 feet below. Of course the quantities stated herein are intended only as examples of a well completion employing this configuration. It will also be understood that this arrangement will also permit a compressor having sufficient horsepower to produce fluids in a conventional manner to be employed at less than that capacity.

Figure 2:
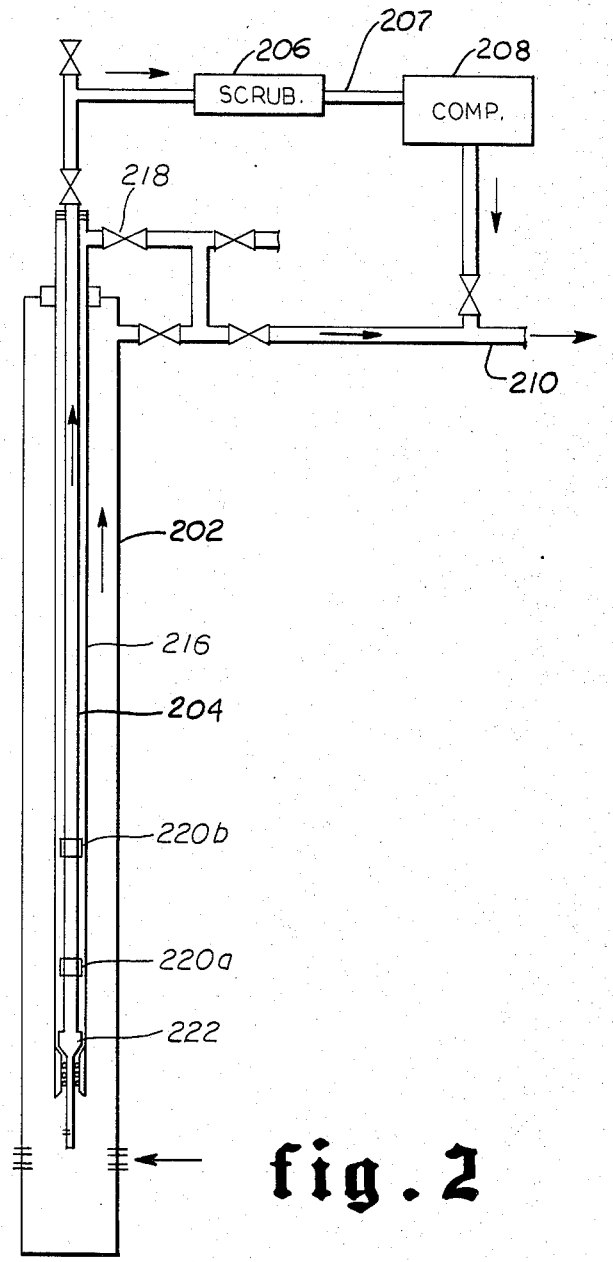
FIG. 2 is a schematic of a well completion for use with a natural gas well in which the shut-in bottom hole pressure in the well is insufficent to independently begin production of gas.

FIG. 2 employs the same principles as illustrated by the completion shown in FIG. 1. The completion shown in FIG. 2 however is intended for use in a well having a shut-in bottomhole pressure insufficient to initiate production by blowdown. If production could be initiated however the use of a small compressor positioned as shown in this configuration would be sufficient to sustain production of dry gas from the formation to the gathering line. The configuration of FIG. 2 employs a third conduit 216 surrounding the smaller inner conduit 204. Production is initiated with this configuration by injecting a high pressure gas at the kickoff manifold 218 to communicate with the annulus between conduit 204 and conduit 216. This gas is forced from the surface of the well to the vicinity of the producing formation. Kickoff subs 220 are positioned at various points along inner conduit 204. In the simplest form these kickoff subs comprise ports communicating between the internal conduit and the annulus between tubing 204 and tubing 216. Gas may enter these ports to aerate the column of liquid in the inner tubing 204. After the flow of a two-phase oil and gas mixture has been initiated in tubing 204, a compressor having a theoretical adiabatic horsepower less than the theoretical adiabatic horsepower required for full wellhead compression will sustain continuous production of a two-phase liquid and gas medium through inner tubing 204 and a primary dry gas recovery through the outer conduit between 216 and casing 202. The kickoff manifold employed for the initial injection of a high pressure gas can then be closed. Of course high pressure gas can subsequently be injected through manifold 218 and tubing string 216 if continuous production through tubing 204 and in the annulus between tubing 216 and casing 202 ceases due to the unexpected accumulation of liquids shutting in the well. Note that a conventional seal assembly 222 can be employed at the base of tubing string 216 to seal the annulus between tubing 216 and tubing 204. Thus the high pressure gas injected into tubing 206 must enter tubing string 204 through kickoff subs 220.

Figure 3:
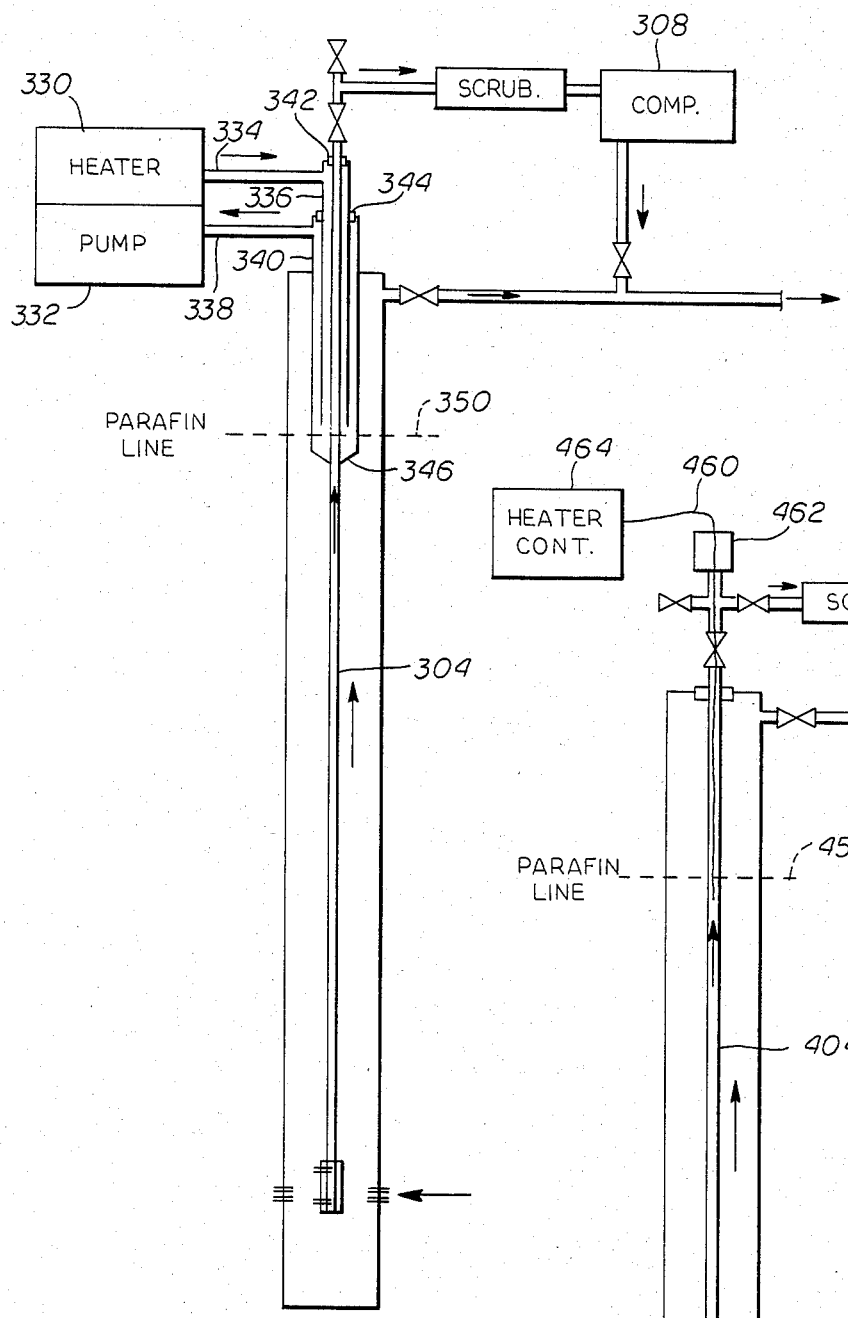
FIG. 3 is a schematic illustration of a well completion for a gas producing well utilizing a compressor to prevent liquid accumulation and including one means for controlling buildup of wax or parafin.

FIG. 3 represents still a further modification of a split-stream liquid-gas production system in accordance with this invention. The configuration shown in FIG. 3 is essentially a modification of the configuration shown in FIG. 1. The kickoff sub and kickoff manifold employed in FIG. 2 are not utilized in the embodiment of FIG. 3. There is however nothing inconsistent with the use of the kickoff subs and kickoff manifolds of FIG. 2 with the embodiment of FIG. 3. FIG. 3 is directed to a mechanism for preventing the buildup of paraffin in the inner tubing 304 carrying the two-phase liquid-gas mixture to the surface. This two-phase system will in some wells include a degree of paraffin produced through tubing string 304. In the tubing string the temperature will reach a point allowing the paraffin to precipitate out and begin to accumulate in the upper portion of tubing string 304. This point is a characteristic of individual wells and is referred to as the paraffin line 350. Normally the precipitation of paraffin in a conventional tubing string is prevented by using wireline tools to scrape or cut the paraffin from the interior of the tubing string. There is however a minimum tubing string diameter required for use of conventional wireline tools to remove paraffin in this manner. In order to promote the removal of liquids through tubing string 304 it is desirable to employ a tubing string 304 having a relatively small diameter. Quite often this diameter will be less than the diameter of tubing strings which will permit the use of conventional parafin removal equipment. Therefore the embodiment of FIG. 3 incorporates a hot water circulating system which prevents the precipitation of paraffin. This hot water circulating system comprises a conventional water heater 330 and a low pressure circulating pump 332 of conventional construction. Both the water heater and the circulating pump can employ gas produced from the well to drive the hot water circulating system. Water in the system heated by water heater 330 is driven by pump 332 in the tubing 334 communicating with tubing string 336. Tubing 336 extends concentrically around inner tubing 304 and a conventional sealing means 342 is located between tubing 304 and 336 at the upper end of the hot water circulating system. Tubing 336 extends downwardly into the well to the vicinity of the paraffin line 350. A second hot water circulating tubing string 340 extends concentrically around tubing strings 336 and 304. Tubing 340 extends into the well to a point below the paraffin line. Conventional sealing means extends between outer tubing 340 and inner hot water circulating tubing 336 at the upper end of the well. The outer tubing 340 is sealed with respect to inner fluid transmission conduit 304 by conventional means at 346 at a point below the paraffin 350. Water heated in water heater 330 and circulated by pump 332 thus travels through tubing 334 through the annulus between tubing 336 and tubing 304 to the paraffin line. Water is then returned through the annular space between tubing 336 and tubing 340 to the surface of the well through tubing 338 back to water heater 330 and circulating pump 332. FIG. 3 thus represents one method of preventing the buildup of paraffin in a well otherwise having the characteristics of the well shown in FIG. 1. Similar quantities of gas and liquids will be produced by the well in FIG. 3 and in FIG. 1. A compressor 308 having the same theoretical adiabatic horsepower as the compressor 108 used in FIG. 1 can be employed.

Figure 4:
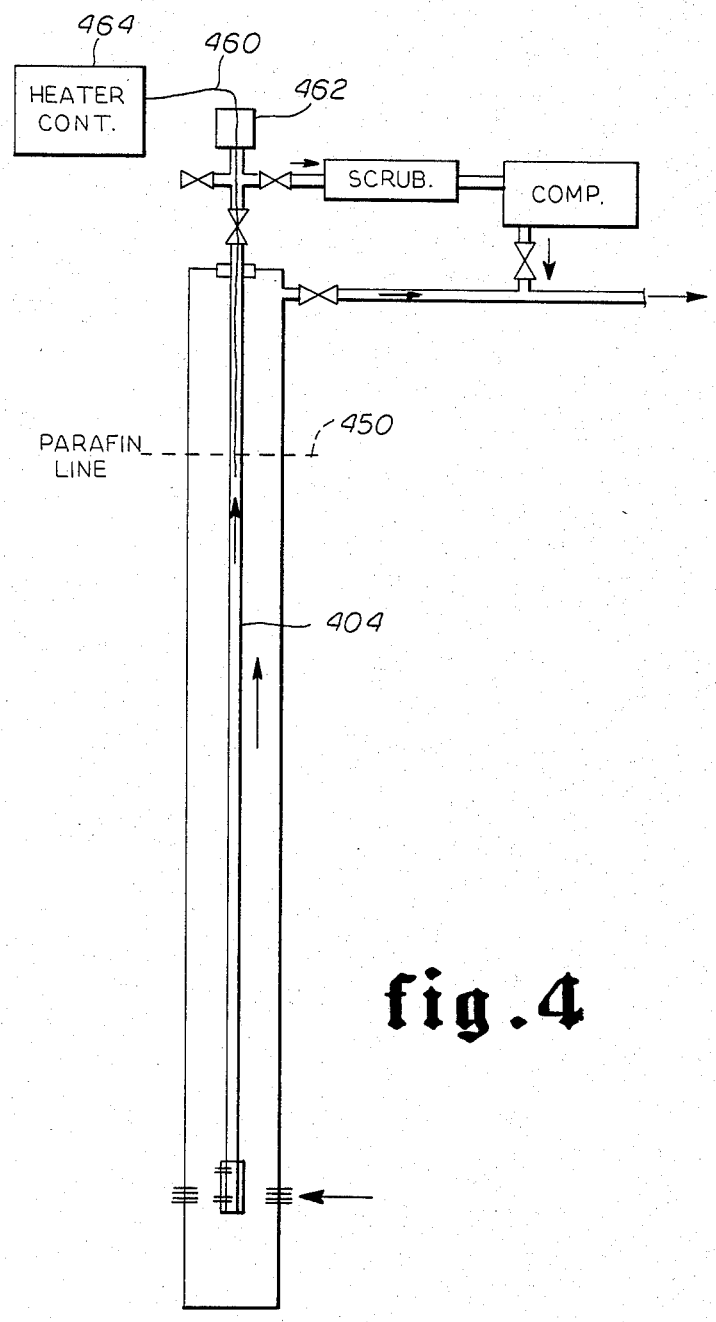
FIG. 4 is also a schematic of a well completion utilizing a compressor to prevent the accumulation of liquid in a gas producing well showing still another method of controlling the accumulation of wax or parafin in the tubing.

The embodiment of FIG. 4 illustrates another method of preventing the buildup of paraffin at paraffin line 450. The well conditions depicted in FIG. 4 are identical to those depicted in FIG. 3. In FIG. 4 a strip electric heating cable 460 is inserted into the liquid-gas phase tubing string 404 by means of a cable feeding adapter 462. The strip heating cable can comprise mineral insulated cable, such as type MI cable manufactured by Pyrotenax USA Inc. This cable has central copper conductors. The surrounding insulation is a highly compressed refractory mineral such as magnesium oxide. The outer sheath can be stainless steel seamless tubing. The conductor can be fabricated by a series of drawing and annealing operations. The cable is free from inflammable materials and fire resistant. By positioning the cable within the tubing string 404. Thus the heat transfer will be radial and heat will be supplied to the flowing liquid gas paraffin containing mixture. A heater controller 464 is then used to heat the inner cable conductors within tubing string 404 to prevent the buildup of paraffin between paraffin line 450 and the surface of the well. A single-phase or three-phase electrical heating system may be used. The heater controller 464, electric cable 460 and the cable feeding mechanism 462 are of conventional construction and the details are not significant to the invention as described herein. Use of the electric heater mechanism shown in FIG. 4 or the hot water recirculating system shown in FIG. 3 represent alternative mechanisms for preventing the buildup of paraffin in a tubing string which in the completion described herein is smaller than conventional tubing strings with which paraffin removal equipment can be employed.

Although the invention has been described in terms of the specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A split-stream assembly for transporting gas at a prescribed flow rate to a surface gathering system from a subterranean producing formation yielding gases and liquids and having, in the presence of accumulating liquids at the producing formation, a bottom hole pressure insufficient to independently transport gas from the producing formation to the surface, comprising:

means for defining separate first and second fluid transmission conduits in said well, extending from the surface of the well to the producing formation, each fluid transmission conduit communicating with the producing formation;

compression means for lowering the pressure in the first fluid transmission conduit at the surface, said compression means communicating with the surface gathering system at a horsepower sufficient to transport a two-phase gas-liquid medium from the formation through the first fluid transmission conduit to the gathering system at a flow rate less than the prescribed flow rate; and an interconnection at the surface of the well establishing gathering system communication with the second fluid transmission conduit whereby a two-phase gas-liquid medium is produced through the first fluid transmission conduit and gas alone is produced through the second fluid transmission conduit, the sum of the flow rates in the first and second fluid transmission conduits being equal to the prescribed flow rate.

2. The assembly of claim 1 wherein the compression means is located at the surface between the first fluid transmission conduit and the surface gathering system.

3. The assembly of claim 1 wherein the cross-sectional area of the first fluid transmission conduit is less than the cross-sectional annular area of the second fluid transmission conduit.

4. The assembly of claim 1 or 3 wherein the means for defining separate first and second fluid transmission conduits comprises a tubular string.

5. The assembly of claim 1 wherein the two-phase flow rate through the first fluid transmission conduit is less than the flow rate of gas through the second conduit.

6. The assembly of claim 5 wherein the theoretical compression horsepower is sufficient to transport gases through the first fluid transmission conduit to the gathering system at a rate less than one-fourth of the rate of gas transported through the second fluid transmission conduit to the gathering system.

7. The assembly of claim 1 wherein the output pressure of said compression means is equal to the pressure in said gathering system.

8. A split-stream assembly for transporting gas at a prescribed flow rate to a surface gathering system from a subterranean producing formation yielding gases and liquids and having, in the presence of accumulating liquids at the producing formation a bottom hole pressure insufficient to independently transport gas from the producing formation to the surface, comprising:

means for defining separate first and second fluid transmission conduits in said well, extending from the surface of the well to the producing formation, each fluid transmission conduit communicating with the producing formation;

compression means, having a theoretical adiabatic horsepower less than the theoretical adiabatic horsepower necessary to transport fluids at the prescribed flow rate from the producing formation to the surface, communicating with the second fluid transmission conduit, the compression means output pressure being equal to the gathering line pressure, and the compression means input pressure being sufficient to permit two-phase liquid-gas transport through the second fluid transmission conduit at flow rates less than said prescribed flow rate; and an interconnection at the surface of the well establishing gathering system communication with the secondary fluid transmission conduit whereby a two-phase gas-liquid medium is produced through the first fluid transmission conduit and gas alone is produced through the second fluid transmission conduit, the sum of flow rates in the first and second fluid transmission conduits being equal to the prescribed flow rate.

9. The split-stream assembly of claim 8 wherein said second fluid transmission conduit comprises a tubular string and said first fluid transmission conduit comprises the annulus between the tubular string and the outer casing in the well.

10. The split-stream assembly of claim 8 wherein the cross-sectional area of the secondary fluid transmission conduit is less than the cross-sectional area of the primary fluid transmission conduit.

11. The assembly of claim 8 wherein the two-phase rate through the second fluid transmission conduit is less than the flow rate through the first fluid transmission conduit.

12. The split-stream assembly of claim 11 wherein the cross-sectional area of the secondary fluid transmission conduit is less than the cross-sectional area of the primary fluid transmission conduit.

13. The assembly of claim 11 wherein the two-phase flow rate through the first fluid transmission conduit is less than the flow rate of gas through the second conduit.

14. A split-stream assembly for transporting gas at a prescribed flow rate to a surface gathering system from a subterranean producing formation yielding gases and liquids and having, in the presence of accumulating liquids at the producing formation a bottom hole pressure insufficient to independently transport gas from the producing formation to the surface, comprising:

means for defining separate first and second fluid transmission conduits in said well, extending from the surface of the well to the producing formation, each fluid transmission conduit communicating with the producing formation;

compression means, having a theoretical adiabatic horsepower less than the theoretical adiabatic horsepower necessary to transport fluids at the prescribed flow rate from the producing formation to the surface, communicating with the second fluid transmission conduit, the compression means output pressure being equal to the gathering line pressure, and the compression means input pressure being sufficient to permit two-phase liquid-gas transport through the second fluid transmission conduit at flow rates less than said prescribed flow rate; and an interconnection at the surface of the well establishing gathering system communication with the second fluid, the pressure in the first fluid transmission conduit at the interconnection being equal to the gathering line pressure; whereby a two-phase gas-liquid medium is produced through the first fluid transmission conduit and gas alone is produced through the second fluid transmission conduit, the sum of the flow rates in the first and second fluid transmission conduits being equal to the prescribed flow rate.

15. The split-stream assembly of claim 14 wherein said secondary fluid transmission conduit comprises a tubular string and said primary fluid transmission conduit comprises the annulus between the tubular string and the outer casing in the well.

16. A method of transporting gas at a prescribed flow rate to a surface gathering system from a subterranean producing formation yielding gases and liquids and having, in the presence of accumulating liquids at the producing formation, a bottom hole pressure insufficient to independently transport gas from the producing formation to a gathering line having a prescribed pressure, the method comprising the steps of: inserting a tubing string between the surface and the producing formation within a primary fluid transmission conduit in the well, the primary fluid transmission conduit communicating directly with the gathering line; and installing a compressor at the surface, having a theoretical adiabatic horsepower less than the theoretical adiabatic horsepower necessary to transport fluids at the prescribed flow rate to the gathering line at the prescribed pressure in the gathering line, the input pressure of the compressor being sufficient to permit two-phase liquid-gas transport through the tubing string at a flow rate less than said prescribed flow rate, and producing gas through the primary fluid transmission conduit; the sum of the flow rate in the tubing string and the primary fluid transmission conduit being equal to the prescribed flow rate.

17. A method of transporting gas at a prescribed flow rate to a surface gathering system from a subterranean producing formation yielding gases and liquids and having, in the presence of accumulating liquids at the producing formation, a bottom hole pressure insufficient to independently transport gas from the producing formation to a gathering line having a prescribed pressure, the method comprising the steps of: inserting a tubing string between the surface and the producing formation within a primary fluid transmission conduit in the well, the primary fluid transmission conduit communicating directly with the gathering line; and installing a compressor, having a theoretical adiabatic horsepower less than the theoretical adiabatic horsepower necessary to transport fluids at the prescribed flow rate to the gathering line at the prescribed pressure, between the tubing string and the gathering line, the output pressure of the compressor being equal to the prescribed pressure in the gathering line, the input pressure of the compressor being sufficient to permit two-phase liquid-gas transport through the tubing string at a flow rate substantially less than said prescribed flow rate, and producing gas through the primary fluid transmission conduit at a flow rate greater than the flow rate through the secondary conduit.

18. A method for transporting gas at a prescribed flow rate to a surface gathering system from a subterranean producing formation yielding gases and liquids and having, in the presence of accumulating liquids at the producing formation, a bottom hole pressure insufficient to independently transport gas from the producing formation to a gathering line having a prescribed pressure, comprising:

providing a primary fluid transmission conduit in the well communicating between the producing formation and the gathering line and a secondary fluid transmission conduit extending between the producing formation and the surface of the well; applying compression to the secondary fluid transmission conduit, at the surface of the well, at a theoretical adiabatic horsepower less than the theoretical adiabatic horsepower necessary to transport well fluids at a prescribed flow rate through the secondary fluid transmission conduit from the producing formation to the gathering line, the compression output pressure being equal to the pressure in the gathering line; the compression input pressure being insufficient for two-phase liquid-gas transport through the secondary fluid transmission conduit at the prescribed flow rate; and producing gas through the primary fluid transmission conduit at a flow rate greater than the flow rate through the secondary conduit; the sum of the flow rates in the primary and secondary fluid transmission conduits being equal to the prescribed flow rate.

* * * * *